US005460521A

United States Patent [19]

Tsai

[11] Patent Number: 5,460,521

[45] Date of Patent: Oct. 24, 1995

[54] INJECTION IGNITER HAVING A SAFETY DEVICE

[76] Inventor: Chin-Lin Tsai, 3F, No. 94, Sec. 4, Chung Hsin Rd., San Chung City, Taipei Hsien, Taiwan

[21] Appl. No.: 349,961

[22] Filed: Dec. 6, 1994

[51] Int. Cl.[6] ..... F23Q 7/12

[52] U.S. Cl. ..... 431/255; 431/153

[58] Field of Search ..... 431/255, 153

[56] References Cited

U.S. PATENT DOCUMENTS 4,292,021 9/1981 Miyagawa ..... 431/255

*Primary Examiner*—Carroll B. Dority

*Attorney, Agent, or Firm*—Bucknam and Archer

[57] ABSTRACT

An injection igniter with safety device including an igniter holder, a fuel storage compartment, a gas outlet device, a sleeve base and an ignition device assembled together and contained in a housing. When a push button is pressed, the button ring thereof is disengaged from a slot to cause a shield to move upward. A slide piece engaging with the shield is also caused to move upward so that its U-shaped slot pulls a gas nozzle upward to release gas. By pressing a piezo electric base, a piezo electric device is caused to generate static electricity which is transmitted by a lead wire leading to an injection nozzle for ignition. When the igniter is not in use, the shield is pushed downward so that the button ring retracts into the slot, causing the gas nozzle to be closed again. The fire will go out by itself when the residual gas in the gas outlet tube is totally burned. Other elements such a clip, a cap, a relay tube and an outer tube may be further included to enhance the functions of the igniter.

11 Claims, 6 Drawing Sheets

INJECTION IGNITER HAVING A SAFETY DEVICE

BACKGROUND OF THE INVENTION

The present invention relates generally to an igniter, and more particularly to an injection type igniter having a safety device.

Conventional lighters, which are a kind of igniters using liquid gas as fuel, are very popular nowadays because they are handy and portable. But because they are very handy, people often put them here and there carelessly, and inquisitive children who like to imitate adults may then easily get hold of one and play with it, which may lead to fire accidents. There are countless instances in which fires are caused by children playing with lighters.

In view of the fact that there are many fire accidents caused by children playing with lighters, European countries and the U.S. have already set safety standards directed to igniters and required conventional igniters to be equipped with safety means; i.e., the user must release the saftety means before ignition. Because such an action of releasing the safety means involves a certain degree of complexity, children are often discouraged from playing with the lighter, thus reducing fire accidents.

Additionally, in places like Europe and the U.S. where barbecue and fire-places are common, igniters are very popular. But because the flame is small and not strong enough, it ususally take a long time for conventional igniters to light a fire; moreover, because the user's fingers tend to be close to the flame or the fire while holding the igniter, the user will feel very uncomfortable due to the heat, especially in very low temperatures.

SUMMARY OF THE INVENTION

The primary object of the invention is to provide an igniter having a safety device, which is capable of generating an intense flame and is comparatively longer in size.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
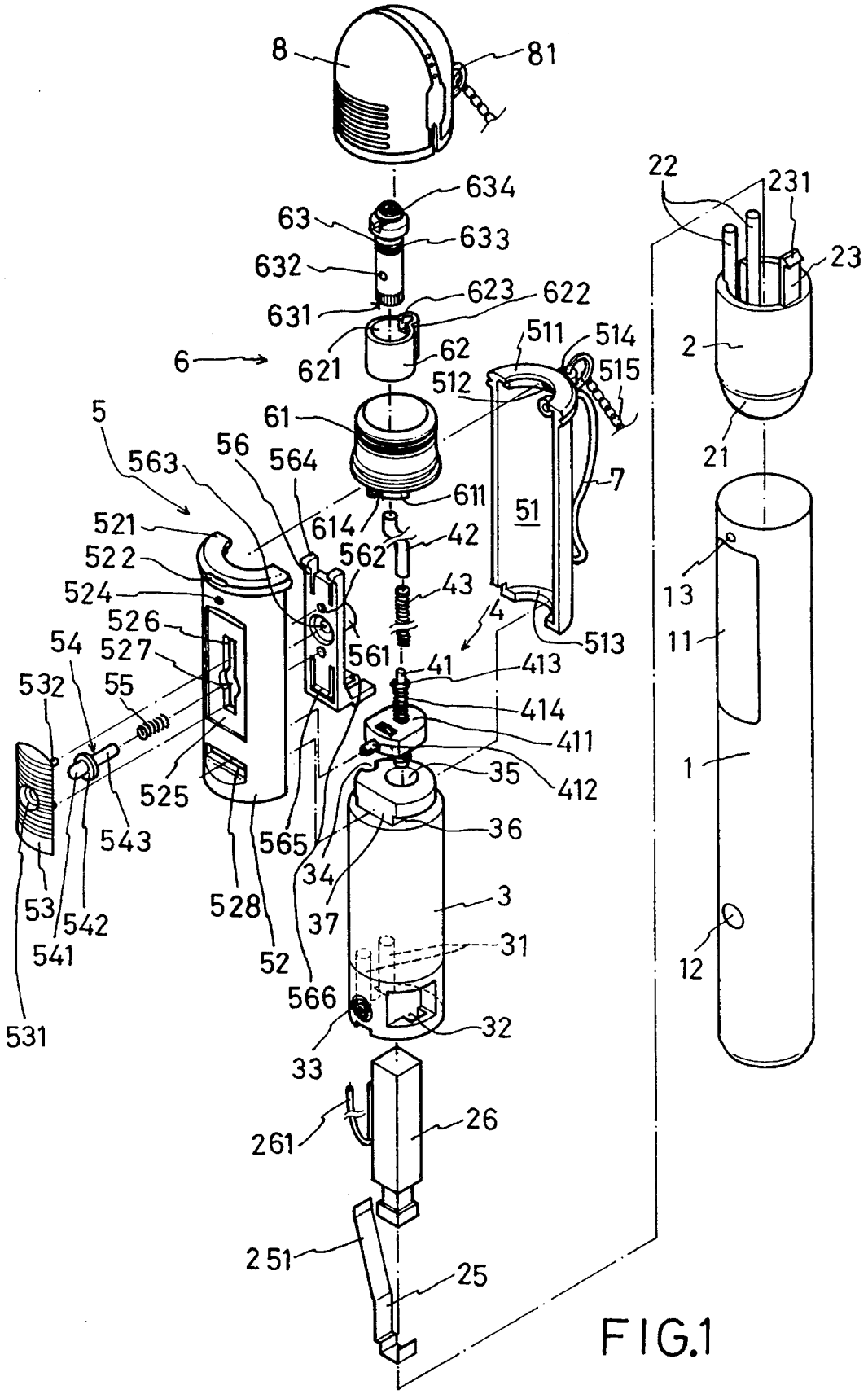
FIG. 1 is a perspective exploded view of the present invention.
Figure 2:
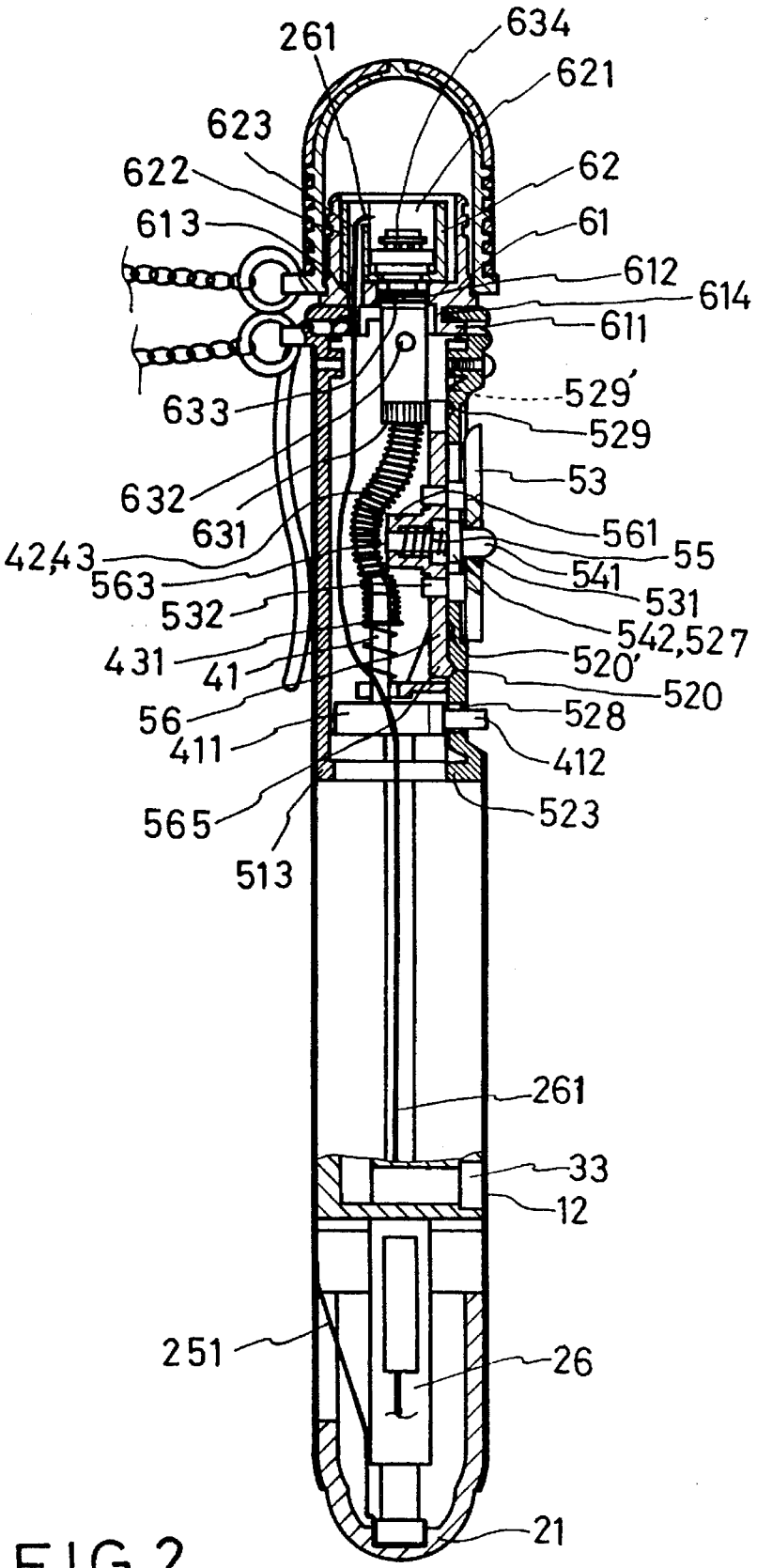
FIG. 2 is a cross-sectional schematic view of the present invention after it is assembled.

With reference to FIGS. 1 and 2, the present invention mainly comprises a housing 1, an igniter holder 2, a fuel storage compartment 3, a gas escape device 4, a sleeve base 5, and an ignition device 6.

The housing 1 is a hollow tubular body which accommodates the elements to be described hereinbelow. Close to the upper end of the housing 1 is a housing orifice 11, and near the lower end thereof is a feed hole 12. A lock hole 13 is further provided above the housing orifice 11.

The igniter holder 2 is a hollow cylinder with an enclosed bottom in which the size of the cylinder corresponds to the bore of the housing 1. The bottom of the igniter holder 2 is provided with a curved piezo electric base 21 which projects from the lower end of the housing 1. The bottom of the igniter holder 2 also extends upwardly to form two slide tenons 22 and a slide retainer 23 for engaging and coupling with the fuel storage compartment 3. The slide retainer 23 has a retaining hook 231 at the upper end thereof. A plurality of seat ribs (not shown) are provided within the igniter holder 2 for engaging and receiving a conductive sheet 25 and a piezo electric device 26. The upper end of the conductive sheet 25 forms an inclined tail 251 which, after assembly, contacts with an inner wall of the housing 1 for conducting electricity, and the piezo-electric device 26 has a lead wire 261.

The fuel storage compartment 3 is a hollow cylindrical body. Its bottom has two holes 31 (not shown) corresponding to the slide tenons 22 and slide retainer 23 as well as a retaining hole 32, for the slide tenons 22 and slide retainer 23 to extend thereinto for sliding movement. Moreover, the retaining hook 231 and the retaining hole 32 are arranged to be in contact with each other so as to restrain the piezo electric device 26 from springing back after it is pressed. A feed hole 33 is further provided at one side between the holes 31 and retaining hole 32 for refilling of liquid fuel. A slot 34 is provided between the two holes 31 for the passage of a lead wire 261. Additionally, a gas outlet hole 35 is provided in the upper end of the fuel storage compartment 3 for engaging with the gas escape device 4. At the same time, in order to secure the engagement with the sleeve seat 5 and ensure the orientation of assembly, a retaining groove 36 and a retaining plane 37 are respectively provided in the lower end and an lateral side of the gas outlet hole 35 to facilitate engagement with the sleeve seat 5.

The gas escape device 4 consists of a gas nozzle 41, a gas outlet tube 42 and a spring 43. A lower portion of the gas nozzle 41 fits in the gas outlet hole 35, and the middle portion thereof has an adjusting ring 411 which is screwed with an adjusting rod 412 so that when the adjusting rod 412 is pulled, the adjusting ring 411 is caused to turn, so as to control the flow of gas. At the same time, The gas nozzle 41 has a retaining ring 413 snapped around the upper portion thereof, and a spring 414 fitted onto the lower portion thereof. The flexible gas outlet tube 42 is fitted into the spring 43 to increase the flexibility thereof so that it may not be easily deformed to affect the flow of gas. The gas outlet tube 42 has one end thereof connected to the gas nozzle 41 and the other end thereof fitted into the ignition device 6.

The sleeve seat 5 consists of a right sleeve 51 and a left sleeve 52 both of which are semi-spherical hollow bodies corresponding to one another. The upper portions of the right and left sleeves 51, 52 are each provided with sleeve rims 511, 521 for engaging with the ignition device 6, sleeve grooves 512, 522 for entrance of air. The lower portions of the right and left sleeves 51, 52 extend to form sleeve rims 513, 523 respectively for engaging with the retaining groove 36.

Additionally, the left sleeve 52 includes a screw hole 524 corresponding to the lock hole 13 in the housing 1; the left sleeve 52 further has a level sleeve plane 525 at a position correponding to the housing orifice 11. In the center of the sleeve plane 525, a vertical slide groove 526 and a circular slot 527 are formed. At the lower part of the sleeve plane 525, a horizontally oriented adjusting slot 528 is disposed for the adjusting rod 412 to pass through.

Besides, a shield 53, a push button 54, a spring 55 and a slide piece 56 are severally connected onto the sleeve plane 525. The shield 53 has a central hole 531 for a button nose 541 of the push button 54 to stick out. The back of the shield 53 extends integrally to form two shield tenons 532 which, after passing through the slide groove 526, engage with the slide piece 56.

The slide piece 56 is an L-shaped member. A tenon 561 and two holes 562 are severally provided on the slide piece 56 at appropriate positions for corresponding to the hole 531 and the shield tenons 532 of the shield 5. The tenon 561 has a hole 563 in the center thereof, and the upper and lower sides of the tenon 561 are respectively provided with two hooks 564 and a tenon hook 565. At the opposite end of the tenon hook 565 is horizontally provided a U-shaped slot 566 for being fitted through the gas nozzle 41 to be connected to the retaining ring 413. In the inner wall of the left sleeve 52, upper positioning holes 529, 529' and lower positioning holes 520, 520' are respectively provided for positioning the corresponding hooks 564 and tenon hook 565.

Prior to assembling the left sleeve 52, the push button 54 should be fitted into the spring 55 and placed inside the tenon 561. Then a button ring 542 will detent the spring 55 so as to prevent it from slipping out. The button ring 542 is placed inside the slot 527, and the shield tenons 532 are passed through the slide groove 526 to engage with the holes 562. At this time the shield 53 and the slide piece 56 are respectively attached to the left sleeve 52 so that the button nose 541 protrudes from the shield's hole 531. Then the hooks 564 and the tenon hook 565 are engaged with the upper positioning hole 529 and the lower positioning hole 520.

The ignition device 6 consists of a jacket 61, a ceramic lining 62 and an injection base 63. The left and right sides of the bottom of the jacket 61 are each provided with a sleeve rim 611, and a slot 614 is also formed therein, for engaging with the sleeve rims 511, 521. A threaded hole 612 is further provided inside the jacket 61, and one side of the jacket 61 is also provided with an outer hole 613. The ceramic lining 62 has a central inner hole 621, and one side thereof extends to form a lug 622 the center thereof forming a hole 623. The injection base 63 is a known device in which the bottom thereof has a hole 631 for connecting to the gas outlet tube 42, the upper side thereof having a through hole 632 for the entrance of air into the injection base 63 to be mixed with fuel gas. The upper side of the through hole 632 is provided with threads 633 for fastening with the threaded hole 612 after the injection base 63 passes through the the inner hole 621. The uppermost end of the injection base 63 is an injection nozzle 634 which, after assembly, it is adjacent to the lead wire 261 which extends via the outer hole 613 and the hole 623 of the lining 62. After the mixed fuel gas is ejected through the injection nozzle 634, by pressing the piezo electric base 21 at the lower portion of the piezo electric device 2, the lead wire 261 will generate sparks to ignite the ejected fuel gas.

With reference to FIG. 2, when assembling the igniter according to the present invention, the piezo electric device 26 and the conductive sheet 25 should be first fitted together and positioned in the igniter holder 2. The slide tenons 22 are then placed into the holes 31, and the slide retainer 23 is inserted into the retaining hole 32, and the retaining hole 32 is fastened with the retaining hook 231, so as to prevent the igniter holder 2 from being separated from the fuel storage compartment 3. If the piezo electric base 21 is pressed upwardly, the igniter holder 2 may, by means of the resilience of the piezo electric device 26, springs back to the extent where the retaining hook 231 and the retaining hole 32 are fastened together. Subsequently, the gas nozzle 41 and the gas outlet hole 35 are tightly coupled together, and the gas outlet tube 42, spring 43, and gas nozzle 41 are connected; the adjusting rod 412 and the adjusting ring 411 are locked together. Then, the injection base 63 is passed through the inner hole 621 and, by means of the threads 633 fastening with the hole 612 of the jacket 61, the injection base 63 and the ceramic lining 62 are fastened within the jacket 61, and the gas outlet tube 42 is connected with the hole 631, forming a gas flow path defined between the fuel storage compartment 3 and the injection nozzle 634. The lead wire 261 is passed via the slot 34 through the outer hole 613 and the hole 623 of the lining 62 to emerge at the side of the injection nozzle 624.

Then the assembled push button 54 and spring 55 are placed inside the tenon 561 of the slide piece 56 so that the button ring 542 is accommodated in the slot 527. The shield tenons 532 are passed through the slide slot 526 and coupled with the holes 562 of the slide piece 56. At this time, the button nose 541 protrudes from the shield's hole 531. Then the sleeve rims 513, 523 are engaged with the retaining groove 36, and the sleeve rims 511, 521 are engaged with the jacket rim 611 and slot 614. The sleeve base 5 is then coupled to the fuel storage compartment 3 and the ignition device 6 respectively. And at this time, the U-shaped slot 566 of the slide piece 56 is connected to the retaining ring 413 on the gas nozzle 41, and the adjusting rod 412 sticks out from the adjusting slot 528. Then the assembled igniter holder 2, fuel storage compartment 3, the gas escape device 4, the sleeve base 5 and the ignition device 6 are placed inside the housing 1. The shield 53 and the adjusting slot 528 are arranged to be exposed from the housing orifice 11, and the feed hole 33 of the fuel storage compartment 3 is made to correspond to the feed hole 12 for the refilling of fuel. Lastly, a screw is caused to penetrate the lock hole 13 to lock within the screw hole 524 in the upper portion of the left sleeve 52, so as to prevent the sleeve base 5 from detaching from the housing 1 and to secure the union of the assembled igniter.

In practical use, the button nose 541 is first pressed down so that the button ring 542 detaches from the slot 527 and the spring 55 is pressed to cause a button rod 543 to project from the hole 563 of the tenon 561; then the shield 53 is pushed upwardly. Since the shield 53 is engaged with the slide piece 56, the slide piece 56 moves upwardly therewith, causing the U-shaped slot 566 to lift the retaining ring 413 upward, so that the gas nozzle 41 releases gas and, at the same time, the hooks 564 and the tenon hook 565 respectively move upwardly from the upper positioning hole 529 and lower positioning hole 520 to upper positioning hole 529' and lower positioning holes 520', so that fuel gas passes from the gas outlet tube 42 into the injection base 63. At this time, the air is drawn in through the hole 632 to mix with the fuel gas to assist combustion. The mixed fuel gas is then ejected via the injection nozzle 634, and at this time, by pressing the piezo electric base 21, the pressed piezo electric device 26 generates static electricity which is transmitted via the lead wire 261 to the vicinity of the injection nozzle 634, the sparks thus generated ignite the fuel gas and the flame produced is a jet type.

When not in use, the shield 53 is moved downwardly so that the button ring 542 displaces to the slot 527. At this time, the spring 55 retracts so that the button ring 542 is accommodated in the slot 527 and the button nose 541 sticks out from the shield hole 531, and the hooks 564 and tenon hook 565 returns to their orginal positions in the upper and lower positioning holes 529, 520 respectively. Since the slide piece 56 follows the shield 53 to move downwardly, the U-shaped slot 566 is also brought to move downwardly so that the gas nozzle 41 is reset and stops supplying gas due to the retraction of the spring 414, and residual gas at the injection nozzle 634 is completely burned.

To facilitate carrying, a clip 7 is insertably disposed in a sleeve slot 512 of the right sleeve 51. In addition, to prevent dirty particles from clogging the injection nozzle 634, a lug 514 may be arranged to extend from the lower portion of the sleeve rim 511 of the right sleeve 51. Besides, a cap corresponding to the bore of the jacket 61 may be provided for sealing the jacket 61. A cap lug 81 may also be provided at a side of the cap 8 for connecting to the lug 514 by means of a chain 515, hence the cap 8 will not be easily lost.

Figure 3:
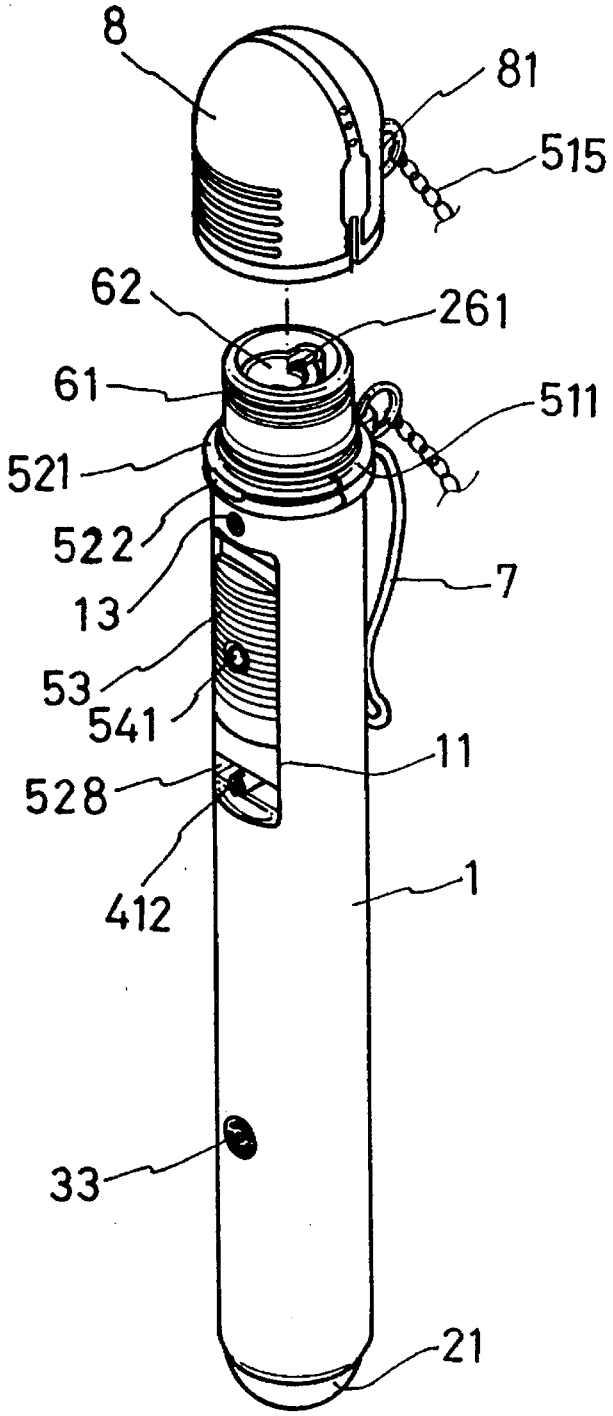
FIGS. 3 and 4 are perspective schematic views of the present invention after it is assembled.
Figure 4:
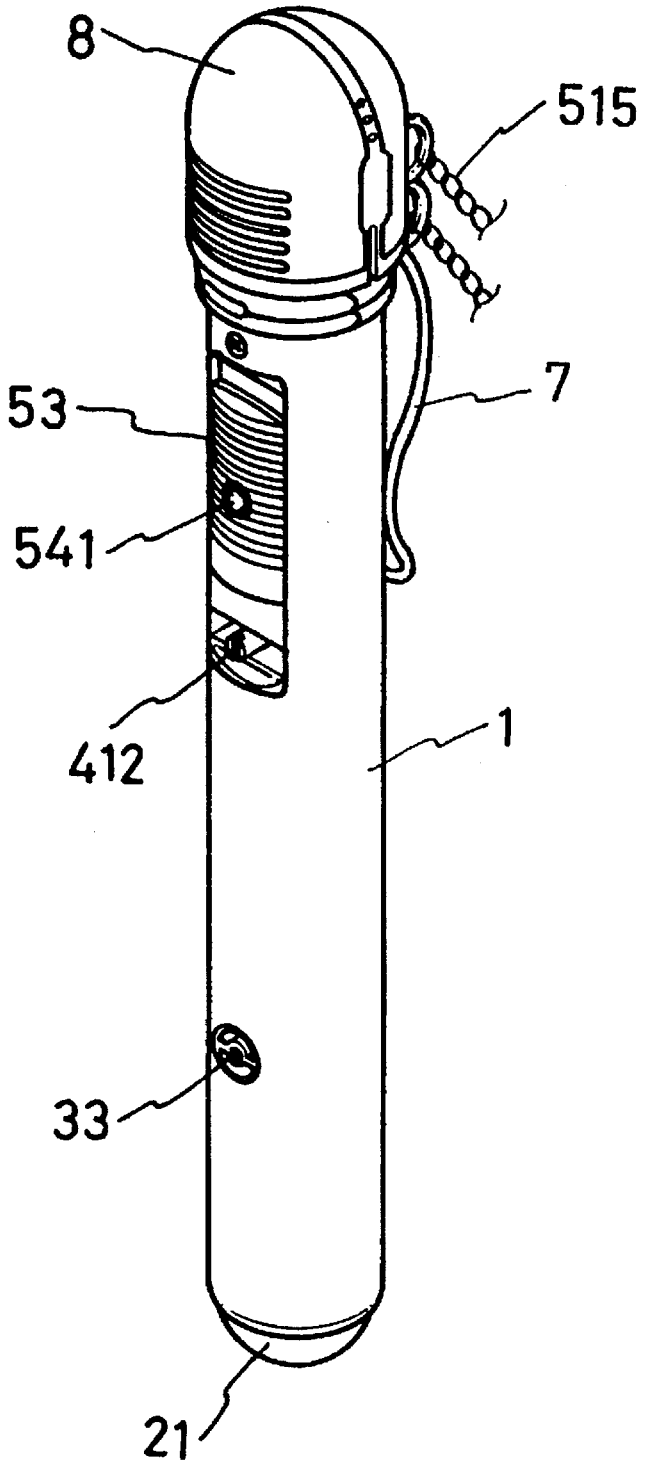

FIG. 3 shows the cap 8 and the jacket 61 joined together, and FIG. 4 shows the cap 8 detached from the jacket 61.

Figure 5:
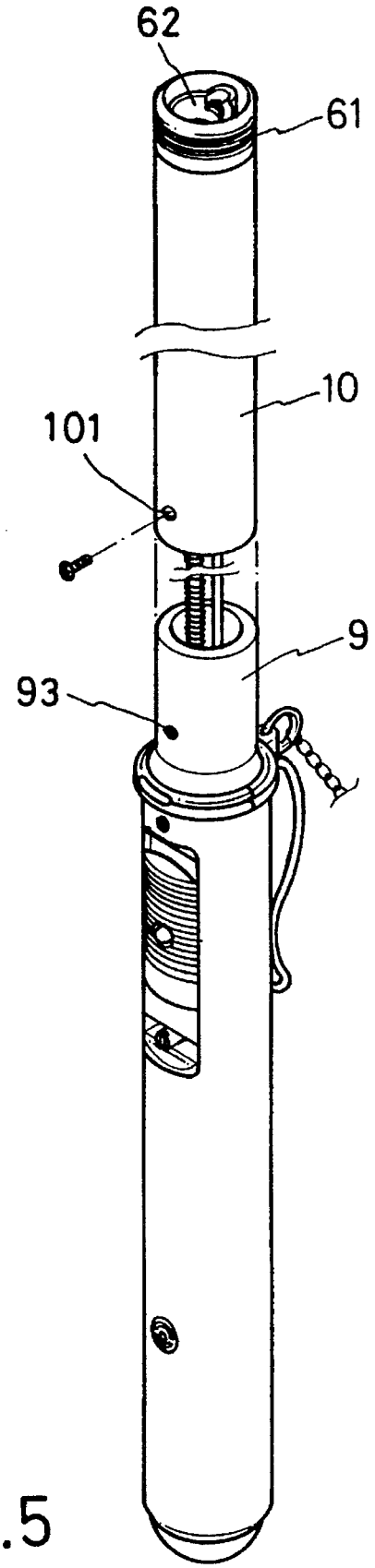
FIG. 5 is a perspective schematic view of another preferred embodiment of the present invention.
Figure 6:
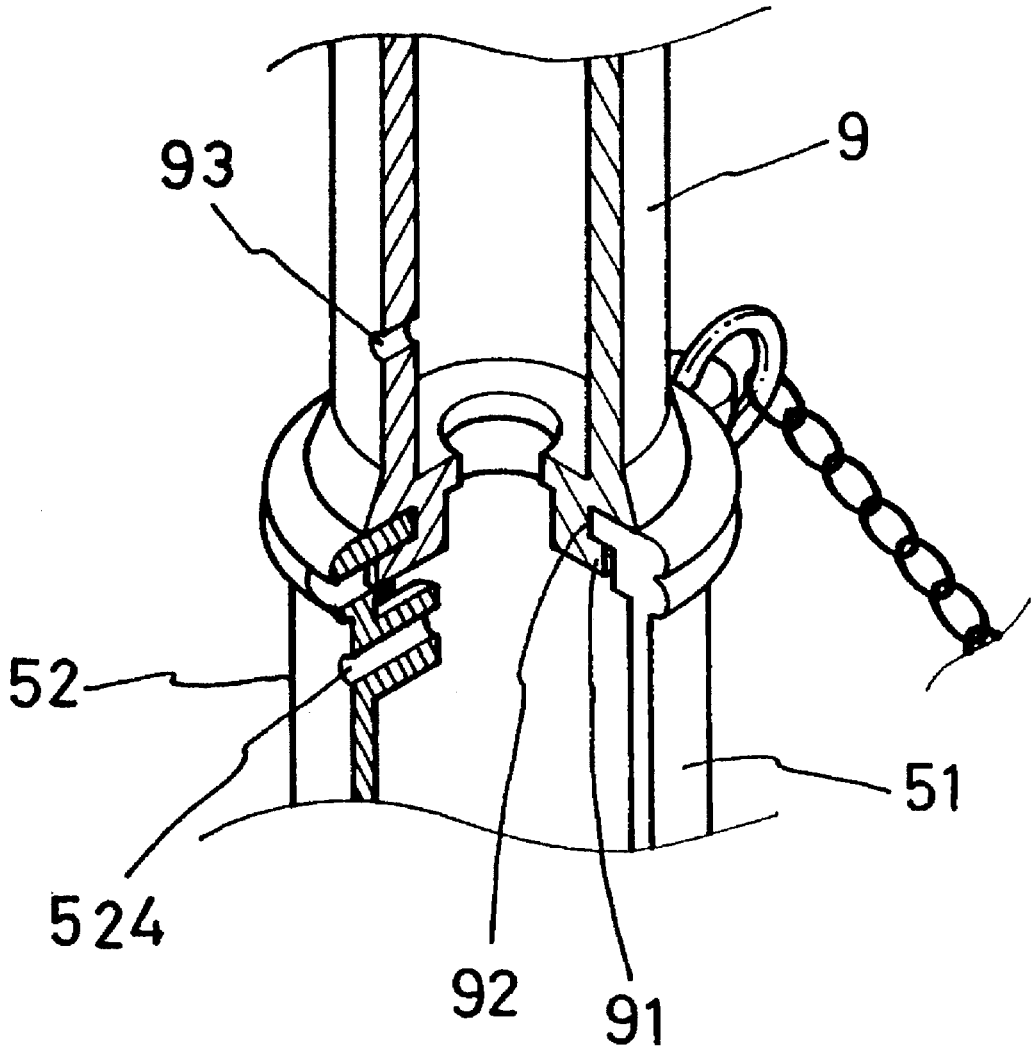
FIG. 6 is a partially enlarged schematic view of another preferred embodiment of the present invention.

FIGS. 5 and 6 are schematic views showing another preferred embodiment of the present invention. As mentioned above, the flame generated by conventional igniters is too short and small so that is not very convenient to use them in lighting a fire. In this embodiment, a relay tube 9 is fitted onto the top end of the left and right sleeves 52, 51. The relay tube 9 has a tube rim 91 and a tube groove 92, and a hole 93 is formed in one side thereof. An elongated hollow outer tube 10 is fitted onto the relay tube 9 and a screw is passed through a hole 101 of the hollow outer tube 10 and the hole 93 of the relay tube 9 to secure them together. In addition, the top end of the outer tube 10 is fitted with the ignition device 6, and the gas outlet tube 42, spring 43 and the lead wire 261 contained therein are likewise configured to extend into the ignition device 6. As the piezo electric device 26 is of the conventional specification, its lead wire 261 is comparatively short in this embodiment. To accommodate the length of the ignition device 6 of the present invention, the lead wire 261 may be joined to another wire to obtain the required length. An insulated sleeve may be fitted around the joint to prevent electricity leakage. To facilitate the engagement of the spring 43 and the gas outlet tube 42, a plurality of springs 43 may be fitted onto the gas outlet tube 42 to prevent the gas outlet tube 42 from being deformed due to its extended length.

Although the present invention has been illustrated and described with reference to the preferred embodiment thereof, it should be understood that it is in no way limited to the details of such embodiment but is capable of numerous modifications within the scope of the appended claims.

What is claimed is:

1. An injection igniter with a safety device, said igniter comprising a housing having a hollow tubular body which accommodates an igniter holder having a piezo electric base, a piezo electric device and a conductive sheet, a gas escape device having a gas nozzle, a gas outlet tube and a spring, a sleeve base having a left sleeve, a right sleeve, a shield and a slide piece, and an ignition device having a jacket, a ceramic lining and an injection base, with said piezo electric base projecting from an lower end of said housing and said ignition device arranged at the upper end thereof, wherein said left sleeve is provided with a screw hole corresponding to a lock hole in said housing and a plane corresponding to a housing orifice in said housing, and said left sleeve has a vertically oriented slide groove and a slot, and an adjusting slot horizontally disposed for an adjusting rod to pass therethrough, and said shield is provided with a hole and two shield tenons extend from the back of said shield so that a button nose of a push button may project through said hole in said shield, wherein a button rod of said push button is fitted with a spring and said shield tenons pass through said slide groove to fit in corresponding holes in said slide piece so that said push button and said spring are accommodated within a tenon of said slide piece while a button ring of said push button is being received in said slot of said left sleeve, said slide piece being provided with a couple of hooks at an upper side thereof and a tenon hook at a lower end thereof, two upper positioning holes and two lower positioning holes being respectively provided in an inner wall of said left sleeve for corresponding to said hooks of said slide piece and said tenon hook, and a U-shaped slot is arranged in said tenon hook which is passed through said gas nozzle to engage with a retaining ring of said gas escape device.

2. An injection igniter having a safety device as claimed in claim 1, wherein said igniter holder integrally extends to form two slide tenons and a slide retainer for engaging with two holes and a retaining hole in the bottom portion of said fuel storage compartment so that said igniter holder and said fuel storage compartment may perform sliding movements, and wherein a retaining hook of said slide retainer is in contact with said retaining hole to restrain retraction of said piezo electric device.

3. An injection igniter having a safety device as claimed in claim 1, wherein said fuel storage compartment has one side thereof provided with a groove for passage of a lead wire of said piezo electric device.

4. An injection igniter having a safety device as claimed in claim 1, wherein said fuel storage compartment is provided with a gas outlet hole in an upper side thereof for engaging with said gas nozzle, and a retaining groove and a retaining plane for engaging with said left sleeve and said left sleeve.

5. An injection igniter having a safety device as claimed in claim 1, wherein a retainer engages with an upper end of said gas nozzle and connects to a gas outlet tube one side of which connects to a hole of an injection base so as to define an air flow path, and wherein an adjusting ring is disposed at a middle section of said gas nozzle, said adjusting ring being locked with an adjusting rod for controlling gas flow.

6. An injection igniter having a safety device as claimed in claim 5, wherein said gas outlet tube is fitted with at least one spring to enhance flexibility and to prevent distortion of said gas outlet tube.

7. An injection igniter having a safety device as claimed in claim 1, wherein said left sleeve and said right sleeve each have a sleeve rim for engaging with a jacket rim and slot of said jacket so that said sleeve base couples with said ignition device, and wherein said injection base of said ignition device penetrates said ceramic lining to lock with said jacket by means of threads in said injection base and a hole of said jacket.

8. An injection igniter having a safety device as claimed in claim 1, wherein a cap is provided on said jacket of said ignition device for coupling to said ignition device so as to prevent dirty particles from clogging said injection nozzle.

9. An injection igniter having a safety device as claimed in claim 8, wherein a lug is provided at an upper side of said right sleeve, and a cap lug is provided at said cap, said lug and said cap lug being joined by a chain.

10. An injection igniter having a safety device as claimed in claim 1, wherein said left sleeve and said right sleeve are each provided with a sleeve groove at the upper ends thereof for the passage of air, and a clip is provided in said sleeve groove of said right sleeve to facilitate carrying.

11. An injection igniter having a safety device as claimed in claim 1, wherein a relay tube is disposed between said left sleeve and said right sleeve in which one side of said relay tube has a hole, and after an elongated outer tube is being fitted onto said relay tube, a screw is passed through a locking hole of said outer tube to be locked with said hole of said relay tube, a top end of said outer tube being engaged with said ignition device for extending the length of said ignition device.

* * * * *